United States Patent [19]

Matuschke

[11] 4,403,549

[45] Sep. 13, 1983

[54] PRINTING PLATE ATTACHMENT ARRANGEMENT

[75] Inventor: Walter Matuschke, Vevey, Switzerland

[73] Assignee: M.A.N.-ROLAND Druckmaschinen Aktiengesellschaft, Offenbach am Main, Fed. Rep. of Germany

[21] Appl. No.: 352,751

[22] Filed: Feb. 26, 1982

[30] Foreign Application Priority Data

Mar. 20, 1981 [DE] Fed. Rep. of Germany ..... 3110982

[51] Int. Cl.[3] ..... B41F 27/12

[52] U.S. Cl. ..... 101/415.1

[58] Field of Search ..... 101/415.1, 378, 383, 101/384, 458; 51/364, 365, 366, 367, 369; 29/118

[56] References Cited

U.S. PATENT DOCUMENTS

| | | | |
|---|---|---|---|
| 1,107,772 | 8/1914 | Fogwell | 101/415.1 |
| 1,471,392 | 10/1923 | Fleming | 101/415.1 |
| 1,927,728 | 9/1933 | Wolff | 101/415.1 X |
| 2,820,409 | 1/1958 | Johnson | 101/415.1 |
| 3,772,991 | 11/1973 | Taguchi et al. | 101/378 X |

FOREIGN PATENT DOCUMENTS

| | | | |
|---|---|---|---|
| 70107 | of 1969 | German Democratic Rep. | 101/415.1 |

*Primary Examiner*—Edgar S. Burr
*Assistant Examiner*—Charles A. Pearson
*Attorney, Agent, or Firm*—Frishauf, Holtz, Goodman & Woodward

[57] ABSTRACT

To provide for smooth running of a plate cylinder with respect to associated rollers or cylinders, such as the blanket cylinder of an offset printing machine, the plate cylinder is formed with an engagement surface (3, 4) including an angle of less than 45° with respect to the tangent of the plate cylinder at the intersection of the engagement surface and the cylindrical surface of the plate cylinder, and cover strips (8, 9) fitting over the plate and having an outer radius of curvature which corresponds to the radius of curvature of the plate cylinder with the plate (7) stretched thereover. The engagement surfaces are formed with holding pins (5, 6) to receive the plate. The outer surface of the cover strips, typically of steel, is hydrophilic and ink-rejecting, for example being knurled, roughened, or granulated to provide for clean margins, the length of the engagement surfaces matching the minimum margin adjacent the subject matter to be printed. When inserted, the cover strips, together with the plate cylinder, form a complete circular outline, thus preventing jolts and shocks from being transmitted to associated cylinders, while permitting a maximum of printed subject matter on a given length of web of paper with clean margins free from ink smear.

2 Claims, 1 Drawing Figure

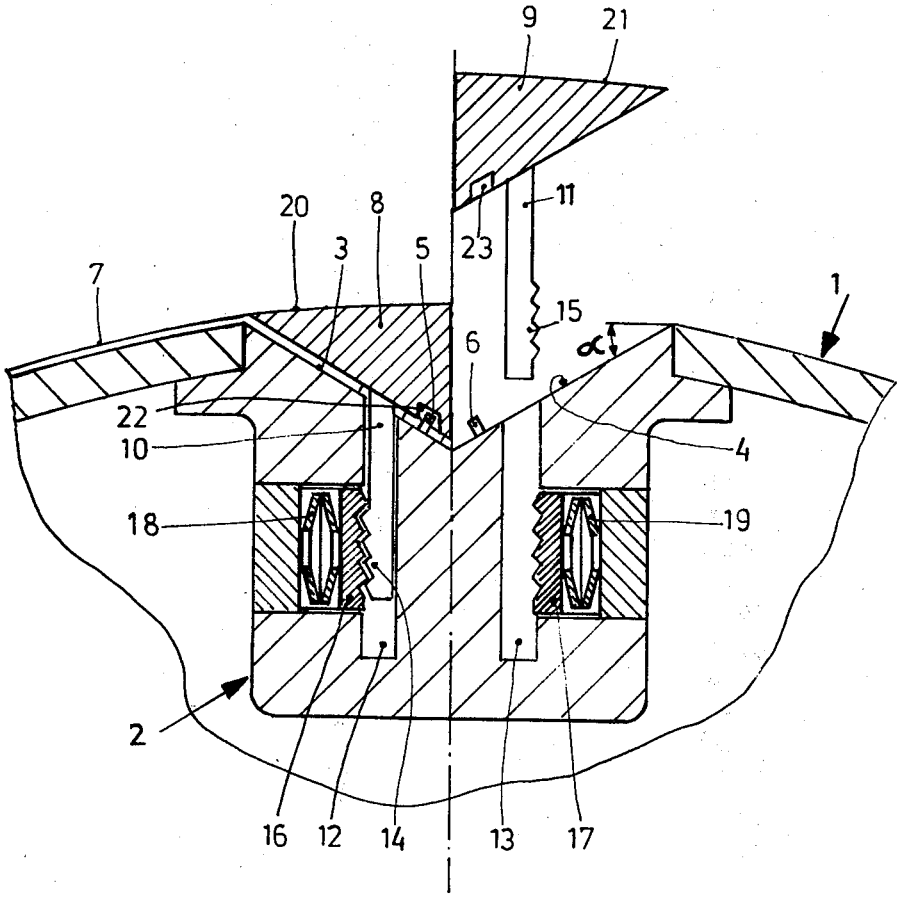
9
21
11
20
8
3
5
23
7
15
1
6
α
22
10
4
18
19
2
16
12
14
13
17

PRINTING PLATE ATTACHMENT ARRANGEMENT

The present invention relates to printing machinery, and more particularly to an attachment arrangement to attach a printing plate to a plate cylinder therefor.

BACKGROUND

Plate cylinders—see, for example, German Published Patent Application DE-AS No. 21 33 890 to which U.S. Pat. No. 3,772,991 corresponds—have been proposed in which the plate cylinder is flattened at the outer circumference in the region of attachment of the printing plate, the flattened surfaces forming engagement surfaces for the marginal regions of the printing plate. A cover can be placed over the flattened surface to prevent lifting off of the end portions of the printing plate from the engagement surfaces. A cylindrical clamping element is located in the center of the cover, positioned in parallel to the axis of the cylinder, and engaging the marginal regions of the printing plate. The outer circumference of the cover is recessed with respect to the outer circumference of the printing cylinder, when covered by the printing plate.

The arrangement, as described, is quite space-consuming, particularly due to the clamping element provided therein. If such a plate cylinder is used in a rotary printing machine, the strips which do not print, that is, where no plate is exposed, result in substantial wide margins, which leads to a loss in paper, that is, printed coverage on the paper web. The recessed outer surface of the cover results in shocks and vibration upon engagement of the plate cylinder with an associated cylinder against which it runs off. Such shocks may lead to danger of damage to bearer rings and bearings for the printing cylinders. If plate cylinders are used which are quite wide, and which may carry two or more plates adjacent each other, vibrations and oscillations in the cylinder can result which reduce the quality of the printed subject matter being obtained. This effect is particularly pronounced if the printing cylinder carries a plurality of printing plates in circumferential direction since, upon each revolution of the printing cylinder, the number of jolts or shocks is increased, tending to cause oscillations of the cylinder system.

THE INVENTION

It is an object to provide a plate cylinder for rotary printing machines, and more particularly for rotary offset printing machines especially adapted for newsprint, magazines, or the like, which has a plate attachment device which is simple and in which jolts and shocks, upon run-of the plate cylinder with respect to an associated cylinder, are effectively avoided, particularly jolts or shocks upon run-off of the plate cylinder with respect to the rubber blanket cylinder; and in which the loss of printed subject matter and hence of paper due to wide attachment zones of the plate is avoided, so that unprinted paper margins between adjacent plates, on the printed subject matter, are effectively reduced to a minimum width.

Briefly, the plate cylinders are formed with circumferentially recessed bearing surfaces extending at an angle of less than 45° with respect to the tangent of the plate cylinder (measured at the intersection of the bearing surface with the cylindrical surface of the plate cylinder), the bearing surface being covered by a cover strip. In accordance with a feature of the invention, the width of the bearing surfaces, each, corresponds essentially to the width of the margins adjacent the subject matter to be printed. The outer surface of the cover strip has a radius of curvature which corresponds to the radius of curvature of the printing plate when stretched over the plate cylinder, in order to provide smooth circumferential dimensions at any angular position of the printing cylinder; and the outer surface of the cover strip has surface characteristics which are hydrophilic, while being ink-rejecting, so that the margins, upon printing, will be clean.

DRAWING

The single FIGURE is a schematic fragmentary cross-sectional view through the plate cylinder of a rotary offset printing machine, illustrating attachment, in accordance with the invention, of a printing plate thereto.

The plate cylinder, schematically shown at 1, has a plate cylinder attachment device, generally shown at 2. The attachment device 2 has two engagement surfaces 3, 4 which extend at an angle $\alpha$ of less than 45° with respect to a tangent of the plate cylinder, measured at the intersection of the engagement surface and the curved circumferential surface of the plate cylinder. The engagement surfaces 3, 4, between each other other, form an obtuse angle. The obtuse angle in the shape of shallow "V" should be selected to be as large as possible. Projections, such as pins 5, 6 extend from the engagement surfaces 3, 4 which are adapted for engagement with suitable holes in a printing plate 7—of which only the left side is shown—stretched over the surface of the plate cylinder 1. The pins 5, 6 insure accurate alignment of the printing plate and, hence, register of printed subject matter. The width of the engagement surface between the outer circumference of the plate cylinder 1 and the engagement line with the other engagement surface is dimensioned to be at least approximately equal to the margin of the subject matter to be printed. Upon printing of newspapers, magazines, journals, and similar material, optimum paper utilization is thus insured.

Each one of the engagement surfaces 3, 4 is covered by a cover strip 8, 9. The cover strips form, when joined and inserted, together, a cover for the plate attachment device 2 towards the outside. The cover strips have holding projections 10, 11 fitting into a slot 12, 13 of the attachment device, and are provided for sliding engagement therein. The holding projections 10, 11 are serrated, as seen at 14, 15 and match similarly serrated edge portions of resiliently held elements 16,17. The compression elements 16, 17 are resiliently held in a suitable axially extending groove by compression springs 18, 19, engaging fixed back portions of the plate attachment device 2, and press the compression elements 16, 17 into engagement with the serrations 14, 15 of the holding projections 10, 11—see left portion of the FIGURE, which shows one of the cover strips 8 inserted into the plate cylinder 1 over a printing plate 7. For insertion, the cover strips 8, 9 are pushed against the plate cylinder and snapped in position by engagement of the serrations on the projections 10, 11 with the matching engagement elements 16, 17.

Other arrangements to hold the cover strips may be used. For example, the holding strips can be held in position by magnets. The cover strips 8, 9 are, additionally, formed with recesses 22, 23 which provide for space to receive the holding pins 5, 6 on which the plate 7 is secured and stretched.

In accordance with a feature of the invention, the outer surfaces 20, 21 of the cover strips are curved with a radius of curvature which corresponds to the radius of the outer surface of the printing plate 7 stretched over the cylinder 1. The cover strips 8, 9 thus supplement the plate cylinder, as ready for printing, to form, in end view, a complete, perfectly round cylinder. In accordance with another feature of the invention, the outer surfaces 20, 21 of the cover strips accept damping fluid or water, but reject ink. A suitable surface can be obtained by forming the cover strips of steel and slightly graining or knurling the outer surfaces 8, 9. As the cylinders then run off with respect to the ink application rollers, no ink will be accepted in the region of the cover strips 8, 9, so that the margins of the resulting printed subject matter will be clean. By forming the cover strips such that the outer surfaces match smoothly against the plate and complement the plate 7, on the cylinder 1, to form a completely circular outline, the cylinder 1, when covered by the plate and with the cover strips in place, will be a perfectly round complete cylinder. Recesses or discontinuities at the outer surfaces of the plate cylinder 1 are thus avoided, and jolts or shocks upon run-off with respect to an associated rubber blanket cylinder are avoided; thus, oscillations within the rubber blanket cylinder or the plate cylinder are avoided, and the overall lifetime of the printing system, and associated components such as bearer rings, bearings and the like, is substantially increased.

In accordance with a preferred feature of the invention, two cover strips 8, 9, each covering half of the groove and associated with one end of a printing plate, are used. Plate cylinders which are so dimensioned, or adapted to operate only with a single plate along the circumference, may utilize a single cover strip which is similar to the combination of the two strips 8, 9, or for example, formed of two strips 8, 9 secured together. The preferred form, however, uses two cover strips since stretching of the printing plate 7 over the circumference of the printing cylinder 1 is facilitated if the printing plate 1 can be located in position at one end, the cover strip, for example strip 8, engaged, and the other end of the printing cylinder 7 then suitably handled and stretched and locked in position by its own individual cover strip 9.

Various changes and modifications may be made and, of course, a plurality of such attachment arrangements may be placed around the circumference of a plate cylinder to position a plurality of plates in circumferential direction around the plate cylinder. The cover strips 9 need not extend through the full axial length of the plate cylinder to accomodate a plurality of plates staggered in axial direction as well, fitting axially against each other to form a complete and uniformly circular cylinder throughout the outer circumference thereof when one or more printing plate or plates 7 is/are installed thereon.

I claim:

1. Printing plate attachment arrangement particularly for newspaper, magazine, journal and similar printing machines to attach a printing plate (7) to a plate cylinder (1) for printing of subject matter on a web of paper, in which the cylinder (1) is formed with an axial groove defining two bearing surfaces (3, 4) thereon, which bearing surfaces (3, 4) meet each other at an obtuse angle to form an obtuse angle of inclination with respect to each other in the shape of a shallow "V" and extend inwardly of a theoretical cylindrical circumference of the plate cylinder, and comprising means (5, 6) for retaining the plate (7) in engagement with the bearing surfaces, said bearing surfaces extending at an angle of less than 45° with respect to a tangent of the plate cylinder at the intersection of the bearing surfaces with the cylindrical surface of the plate cylinder, two cover strips (8, 9) essentially filling the groove and fitting over the plate on the bearing surfaces (3, 4), each cover strip covering one of the bearing surfaces and covering one edge or marginal strip of the plate only, and having a first surface matching the underlying bearing surface and an outer surface corresponding to the theoretical cylindrical circumference of the plate cylinder (1) with the printing plate (7) thereon;

and means (10, 16; 11, 17) for securing the cover strips (8, 9) in the groove;

wherein the dimension—in circumferential direction with respect to the cylinder—of the bearing surfaces, each corresponds essentially to the width of the margins adjacent the subject matter to be printed;

the outer surfaces (20, 21) of the cover strips (8, 9) have radii of curvature which correspond to the radius of curvature of the printing plate stretched over the plate cylinder to form therewith an essentially continuous cylindrical surface;

and wherein, further, the outer surfaces of the cover strips have a surface characteristic which is hydrophilic and ink-rejecting, said outer surfaces being of steel which is roughened or granulated or knurled to form said hydrophilic and ink-rejecting surface characteristic.

2. Printing plate attachment arrangement particularly for newspaper, magazine, journal and similar printing machines to attach a printing plate (7) to a plate cylinder (1) for printing of subject matter on a web of paper, in which the cylinder (1) is formed with an axial groove defining two bearing surfaces (3, 4) thereon, which bearing surfaces (3, 4) meet each other at an obtuse angle to form an obtuse angle of inclination with respect to each other in the shape of a shallow "V" and extend inwardly of a theoretical cylindrical circumference of the plate cylinder, and comprising means (5, 6) for retaining the plate (7) in engagement with the bearing surfaces, said bearing surfaces extending at an angle of less than 45° with respect to a tangent of the plate cylinder at the intersection of the bearing surfaces with the cylindrical surface of the plate cylinder, two cover strips (8, 9) essentially filling the groove and fitting over the plate on the bearing surfaces (3, 4), each cover strip covering one of the bearing surfaces and covering one edge or marginal strip of the plate only, and having a first surface matching the underlying bearing surface and an outer surface corresponding to the theoretical cylindrical circumference of the plate cylinder (1) with the printing plate (7) thereon;

and means (10, 16; 11, 17) for securing the cover strips (8, 9) in the groove;

wherein the dimension—in circumferential direction with respect to the cylinder—of the bearing surfaces, each corresponds essentially to the width of the margins adjacent the subject matter to be printed;

the outer surfaces (20, 21) of the cover strips (8, 9) have radii of curvature which correspond to the radius of curvature of the printing plate stretched over the plate cylinder to form therewith an essentially continuous cylindrical surface;

wherein, further, the outer surfaces of the cover strips have a surface characteristic which is hydrophilic and ink-rejecting;

and wherein the means for securing the cover strips comprises a depending holding projection (10, 11) projecting inwardly of the groove from the respective cover strips;

serrations (14, 15) formed on said holding projections;

and spring-loaded engagement elements (16, 17) having serrations matching the serrations on said holding projections located within the groove.

* * * * *